US005377590A

United States Patent [19]

Bolza-Schünemann et al.

[11] Patent Number: 5,377,590

[45] Date of Patent: Jan. 3, 1995

[54] METHOD AND APPARATUS FOR THE ACCURATE REGISTERING AND MOUNTING OF PRINTING PLATES ON FORME CYLINDERS

[75] Inventors: Hans-Bernhard Bolza-Schünemann; Erich G. Wieland, both of Würzburg, Germany

[73] Assignee: Koenig & Bauer Aktiengesellschaft, Wurzburg, Germany

[21] Appl. No.: 30,882

[22] Filed: Mar. 12, 1993

[30] Foreign Application Priority Data

Mar. 12, 1992 [DE] Germany ..... 4208179

[51] Int. Cl.[6] ..... B41F 27/00

[52] U.S. Cl. ..... 101/389.1; 101/382.1; 101/486; 33/621; 33/616

[58] Field of Search ..... 101/378, 382.1, 383, 101/389.1, 401.1, 415.1, 481, 485, 486, DIG. 36; 33/614, 616, 617, 620, 621; 156/384, 385, 386, 387, 388

[56] References Cited

U.S. PATENT DOCUMENTS 3,186,336 6/1965 Kirby .
3,481,270 12/1969 Schaeffer .
3,515,617 6/1970 Schaeffer .
4,177,730 12/1979 Schriber et al. ..... 101/485
4,793,254 12/1988 Wright et al. ..... 101/481

FOREIGN PATENT DOCUMENTS 1807041 3/1960 Germany .
1273542 7/1966 Germany .
1561185 6/1967 Germany .
2201873 1/1972 Germany .
1054838 1/1967 United Kingdom .

*Primary Examiner*—Ren Yan
*Attorney, Agent, or Firm*—Jones, Tullar & Cooper

[57] ABSTRACT

The accurate registering and mounting of flexible printing plates on a forme cylinder is accomplished by mounting a printing plate to be brought into proper registration on a support which is adjustable in three degrees of freedom and by then superimposing the supported printing plate with a properly registered transparent proof. The plate is brought into proper registration by adjustment of the support using the proof as a reference. The now registered plate is carried by the support to a position where it can be applied to the forme cylinder. A computer may be used to aid in effecting proper register of the plate with reference to the transparent proof.

12 Claims, 4 Drawing Sheets

METHOD AND APPARATUS FOR THE ACCURATE REGISTERING AND MOUNTING OF PRINTING PLATES ON FORME CYLINDERS

FIELD OF THE INVENTION

The present invention is directed generally to a method and apparatus for the accurate registering and mounting of a printing plate on a forme cylinder. More particularly, the present invention is directed to a method and apparatus for accurately registering and mounting of flexible printing plates on the periphery of a forme cylinder. Most specifically, the present invention is directed to a method and apparatus for accurately registering and mounting a flexible or photopolymeric printing plate or plates on the periphery of a forme cylinder. The forme cylinder is positioned in a support that also carries a locating shield which can accurately support a transparent proof of the product to be printed. The flexible printing plate that is to be secured to the plate cylinder is initially secured to a suction fork assembly. The suction fork assembly and the locating shield are superimposed in front of the cylinder and the flexible printing plate is located on the suction fork assembly using the locating shield as a guide. Once the printing plate on the suction fork has been properly aligned or registered, it can be applied to the periphery of the forme cylinder in proper registry.

DESCRIPTION OF THE PRIOR ART

The accurate positioning or registering of a printing plate on the surface of a printing plate or forme cylinder has always been an important element in the attainment of quality printing procedures. Particularly in a situation where multiple printing plates are required for the production of a multiple color finished product and where each color is applied to the product in a sequential manner by different plates on different cylinders, the accurate positioning or registration of each plate on each cylinder is of paramount importance. Register errors give rise to superimposed colors or spaces with no color. Thus it is very important that each printing plate be placed on the plate cylinder in accurate register.

In the German patent specification No. 12 37 542 there is disclosed a mounting device which is usable for mounting printing plates on flexible base plates, in which several carrier plates are clamped on a mounting cylinder adjacent each other. Each individual carrier plate is provided for receiving printing plates for a particular color. At first, the printing plates are registered with reference to a transparent, curved mounting tray and are held by suction air. The mounting tray itself can be shifted parallel to the mounting cylinder and is formed so that it can lock in at predetermined points when it is moved to the mounting cylinder. The printing plates are secured sequentially by means of an adhesive foil that is coated on both sides with an adhesive, on the carrier plates of the mounting cylinder, without being further registered.

A limitation of this prior art device is that the mounting cylinders and the guide rods have to be very long to accomplish the required shifting of the mounting tray. This length of the cylinder and the guide rods allows them to bend so that various deflections are possible. These deflections interfere with the accurate mounting of the printing plates on the plate or forme cylinder.

A German patent of addition No. 15 61 185 augments the teachings of the German patent specification No. 12 73 542 and provides an assembly which allows the printing plate to be adjusted in three directions or degrees of freedom, namely horizontally, vertically and by rotation. In this device, the printing plate is positioned with its undersurface on a stationary, curved register plate and is held against the register plate by a suitable suction force. A curved or bent mounting plate which consists of a transparent proof of the desired resultant printed product, is pivoted or otherwise moved over the printing plate. The printing plate that is held on the register plate is then brought into register with the transparent proof. After this registration has been accomplished, the printing plate is transferred with its printing side, such as a relief side, to the mounting plate, through the use of suction. In the meantime, the suction air supply on the register plate is turned off. This allows the printing plate to now be supported on the mounting plate with its undersurface exposed. The mounting plate with the attached printing plate can now be moved away from the register plate and moved in an axial direction in relation to the forme cylinder into a position where it can be glued or otherwise adhered to the forme cylinder. The printing plate is then glued to the forme cylinders and the suction to the mounting plate is turned off so that the mounting plate can be moved away from the forme cylinder.

A limitation of this prior art device is that the printing plate, which has been registered on the register plate to which it was initially attached, is transferred to the mounting plate. This single transfer creates registration inaccuracies that result in printing errors. This is due partly to the fact that it is the relief or printing side of the printing plate that is brought into engagement with the mounting plate as the printing plate is transferred from the register plate to the mounting plate.

A limitation of both of these prior art devices is that they are both usable only with printing plates that have an inflexible carrier plate. If they are used with a flexible printing plate, register errors result since the flexible printing plates are deformed when a suction force is applied to their relief side. This prior art procedure is also very costly since it requires the utilization of curved carrier plates whose radius of curvature must be the same as that of the plate or forme cylinder to which the printing plate will be applied.

It will be seen that a need exists for a procedure to accomplish the accurate register of printing plates. The method and apparatus for accurate registration and mounting of printing plates on forme cylinders in accordance with the present invention provides such a procedure and is a significant advance over the prior art devices and procedures.

SUMMARY OF THE INVENTION

It is an object of the present invention to provide a method and apparatus for registration and mounting of printing plates on forme cylinders.

Another object of the present invention is to provide a method and apparatus for accurately registering and mounting flexible printing plates on forme cylinders.

A further object of the present invention is to provide a method and apparatus for accurately registering and mounting photopolymeric wraparound printing plates on forme cylinders.

Still another object of the present invention is to provide a method and apparatus for accurately registering and mounting flexible printing plates on forme cylinders of various diameters.

Even a further object of the present invention is to provide a method and apparatus for accurately registering and mounting printing plates of different subjects on the peripheries of several forme cylinders for separated colors as well as with one-up as well as with multiple-ups at a good repeat accuracy of the positioning on the forme cylinders.

As will be discussed in greater detail in the description of the preferred embodiment which is set forth subsequently, the method and apparatus for accurately registering a printing plate on a forme cylinder in accordance with the present invention starts by positioning the forme cylinder on a support assembly. A locating shield is positioned at one end of the support assembly. This locating shield can receive a transparent proof of the product to be printed with this transparent proof being positionable in proper register. Alternatively the locating shield can utilize a pair of magnifying lenses on a cross support. The flexible printing plate that is to be secured on the forme cylinder is supported at its upper and lower edges between spaced suction arms of a suction fork assembly. This suction fork assembly is movable to shift the flexible printing plate horizontally, vertically, and to rotate it about a center. The suction fork and the locating shield are placed in a superimposed position and the flexible plate is adjusted or repositioned while being held on the suction fork by using the locating shield as a guide. Once the flexible printing plate is properly positioned on the suction fork, this assembly can be moved to bring the printing plate into engagement with the forme cylinder.

A significant advantage of the method and apparatus of the present invention is that the flexible printing plate is positioned on the suction arms of the suction fork in a planar manner and is not then moved or shifted with respect to the suction arms during registration. While the suction arms are movable as a unit, the flexible plate is not shifted with respect to the arms. This ability of the suction fork to shift in three degrees of freedom and to move into position with respect to the forme cylinder while not shifting the printing plate with respect to the suction arms provides a highly accurate registration of the printing plate. The high degree of accuracy is maintained during the transfer of the printing plate to the forme cylinder. In contrast with the prior art devices, once the printing plate has been positioned on the suction fork assembly, it is not moved relative to the fork assembly until it is transferred to the forme cylinder. The additional transfer steps required in the prior art, as well as the holding of the printing plate on its relief or printing side are avoided by the present invention. Repeat accuracy can be maintained when positioning the printing plate on the predetermined glue point on the forme cylinder by utilization of data from a CAD-installation that may have already been used for the design to be printed. This is particularly true when multiple color prints are being produced using a common impression, multiple color flexographic printing press.

The utilization of a computer in the control desk of a printing machine which utilizes the present invention will allow linear and non-linear corrections of distances of the subjects to each other. Such corrections are often required when it is ascertained that the paper web width changes. These changes are the result of experimental values.

It will be seen that the method and apparatus for accurate registration and mounting of the printing plates on forme cylinders in accordance with the present invention overcomes the limitations of the prior art and provides a procedure and process which is a substantial advance in the art.

BRIEF DESCRIPTION OF THE DRAWINGS

While the novel features of the method and apparatus for accurate registration and mounting of printing plates on forme cylinders in accordance with the present invention are set forth with particularity in the appended claims, a full and complete understanding of the present invention may be had by referring to the detailed description of the preferred embodiment, which is presented subsequently, and as illustrated in the accompanying drawings, in which:

DESCRIPTION OF THE PREFERRED EMBODIMENT

Presently, cardboard products which have multiple color printing are frequently designed in printing firms through the use of CAD installations. These designs are accomplished so that the form of the punching cuts, the positioning of the folds and imprints, the lengths of the repeats and the like are determined for this material in a plane condition. The uppermost paper ply of what will be a corrugated cardboard carton is printed in its multiple color configuration and is then secured to the underlying corrugated cardboard. The uppermost layer of paper which will become the covering ply for this kind of corrugated cardboard product is frequently produced in a common impression flexographic press with six inking units. The data from the CAD generated designs are usable for effecting the positioning of the imprints and the circumferential length of the repeats.

It is necessary that the printing plates, which will be used to print these multiple color covering plies of paper, be mounted on the plate or forme cylinder in accurate register. The present invention is utilized to accomplish this register accurate registering and mounting of the printing plates on the forme cylinder.

Figure 1:
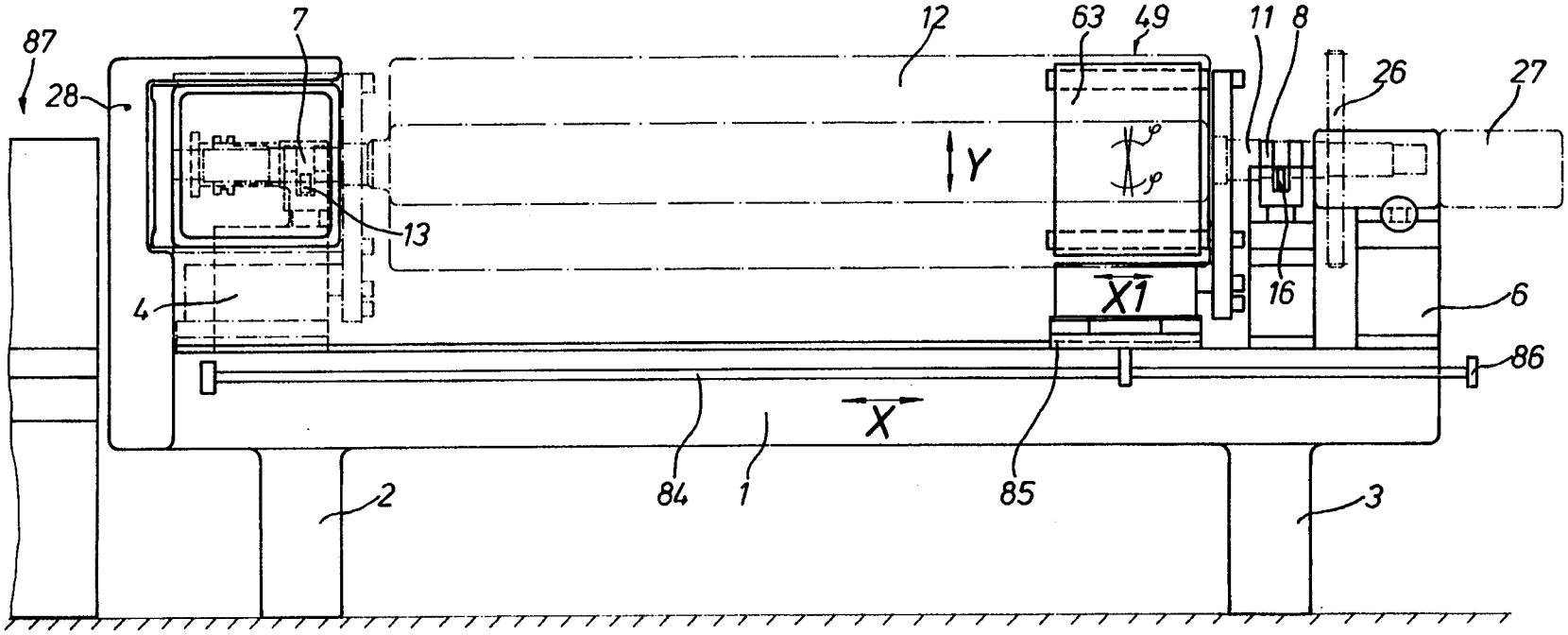
FIG. 1 is a front view of the apparatus for accomplishing the accurate registration and mounting of a printing plate on a printing cylinder in accordance with the present invention.

Referring initially to FIG. 1, there may be seen an apparatus in accordance with the present invention for accomplishing the accurate registration and mounting of printing plates on a plate cylinder. The assembly utilizes a machine frame 1 which is supported by spaced support feet 2 and 3. A pair of upwardly extending bearing brackets 4 and 6 that have bearing supports 7 and 8 are used to receive the axle trunnions 9 and 11 of a forme cylinder 12 to which the flexible printing plates will be secured. It will be understood that the forme cylinder 12 has been removed from the press assembly in which it normally operates and has been placed on the machine frame 1. The bearing supports 7 and 8 have spaced rolls 13, 14, 16 and 17 which receive and support the axle trunnions 9 and 11 of the forme cylinder 12.

A first bearing bracket 6 is securely attached to the machine frame 1 while a second bearing bracket 4 is shiftable along a guide support (not specifically shown) in the axial direction of the forme cylinder 12. This allows the machine frame 1 to accommodate forme cylinders 12 of varying lengths. A suitable clamping screw 18 is used to lock the axially adjustable second bearing bracket 4 at a desired position. The first bearing bracket 6 may be provided with a drive assembly 19 that includes a drive motor, a gear, an impulse transmitter, and a pinion 21. The drive assembly 19 is arranged in a support 22 and can be shifted so that the pinion 21 engages the drive gear 26 of the forme cylinder 12. This will allow the forme cylinder 12 to be rotated while it is being supported in the machine frame 1. The drive assembly 19 can be moved on support 22 by means of a threaded spindle 23 and an adjustment wheel 24, as is shown more clearly in FIG. 2. Alternatively, the forme cylinder 12 could be rotated by a drive assembly attached to the axle trunnion 11. This is shown in FIG. 1 in dashed lines at 27. This drive assembly 27 could include a drive motor, a gear, and an impulse transmitter. Either drive means 19 or 27 could be controlled from the control stand or desk of the assembly.

Figure 4:
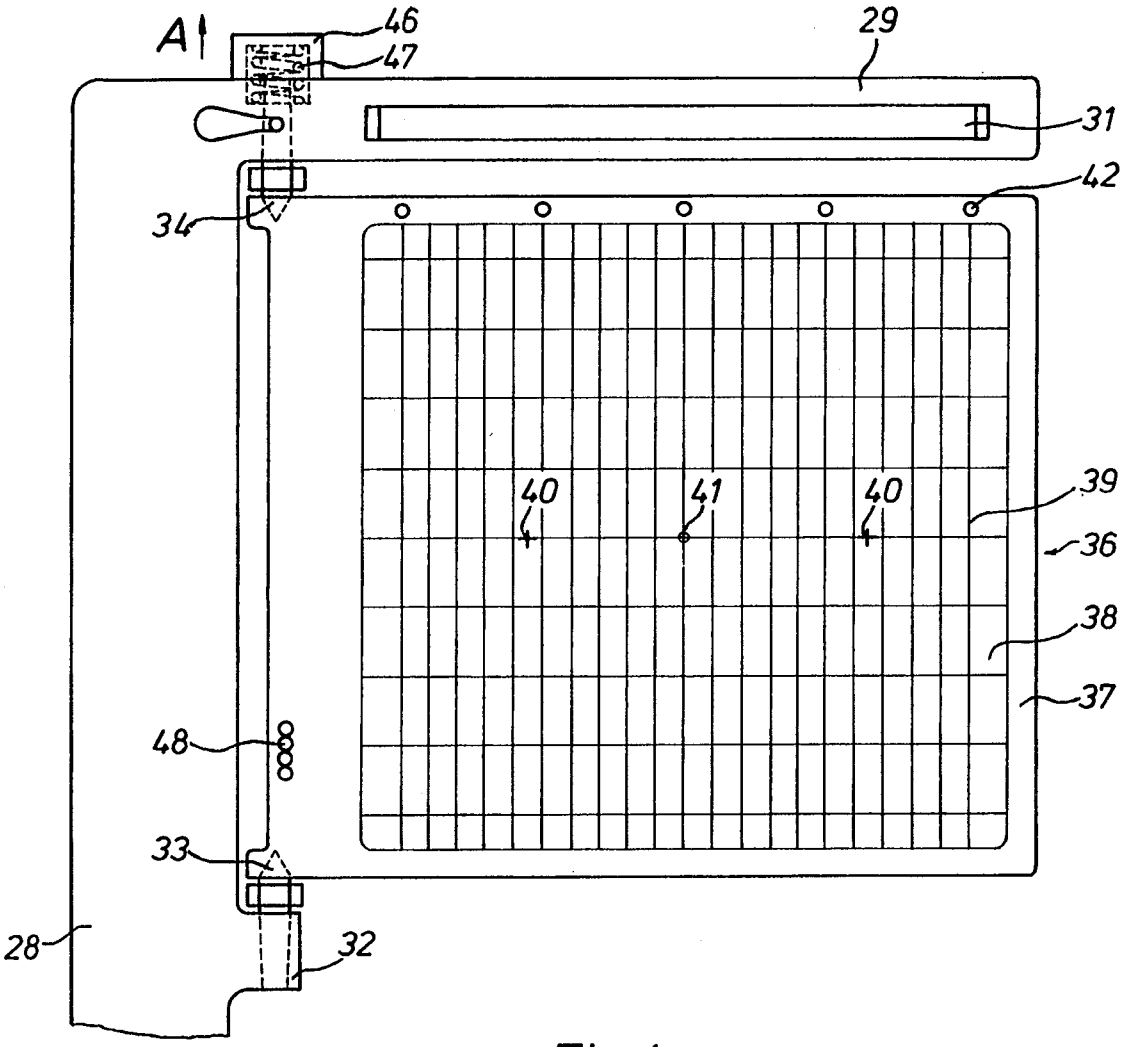
FIG. 4 is a detailed front elevation view of a first preferred embodiment of a locating shield in accordance with the present invention.
Figure 3:
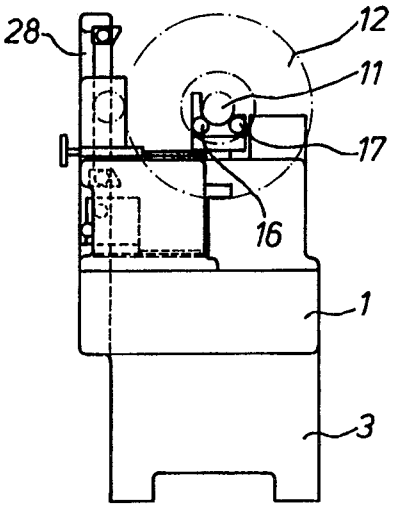
FIG. 3 is an end view of the apparatus taken from the right as seen in FIG. 1.

Referring again to FIGS. 1 and 2, and also turning to FIG. 4, there is shown a first embodiment of a locating shield for use in the apparatus of the present invention. The machine frame 1 has at its end adjacent the second or adjustable bearing bracket 4 a generally vertical arm 28 which terminates at its upper end portion in a generally horizontally extending connecting bar 29. This connecting bar 29 carries an elongated tubular lamp 31, such as a fluorescent lamp with an auto-glare shade. A first vertical bore is formed in the connecting bar 29 generally adjacent the vertical arm 28 and a second vertical bore is formed in a nose 32 on the arm 28. These two vertical bores are in vertical alignment and receive bearing bolts 33 and 34 which are provided with tapered cones at their ends which face each other, all as is shown most clearly in FIG. 4. These cones are receivable in and pivotably support an inboard end of a locating shield, generally at 36. This locating shield 36 consists of a frame 37 that supports a transparent screen 38. The transparent screen 38 has horizontally and vertically extending register lines 39. A zero point 41 and two register crosses 40 are delineated on the transparent screen 38. The upper horizontal member of frame 37 is provided with a plurality of spaced pins 42 that are used to receive the locating foil. The upper bearing bolt 34 is movable generally vertically by actuation of a double armed lever 44 which is supported on a pivot 43, as may be seen in FIG. 7. A counteracting spring 46 that is carried in a housing 47 on the horizontal connecting bar 29 exerts a downward force against the upper bearing bolt 34. This assembly allows the upper bearing bolt 34 to be elevated so that a particular locating shield 36 can be removed and another locating shield 36 substituted for it. These various exchangeable locating shields 36 are each provided with individual, different identification marks 48, such as with visible numbers or with various sensors that can be scanned electronically. A suitable registering of the number 48 or mark can also be accomplished by a generally known register mark reader or by means of a suitable video system. This first embodiment of the locating shield 36 or a second embodiment which is shown primarily in FIG. 7, and which will be discussed in detail subsequently, is used to provide a reference assembly to which a flexible printing plate is compared and placed into alignment.

Figure 2:
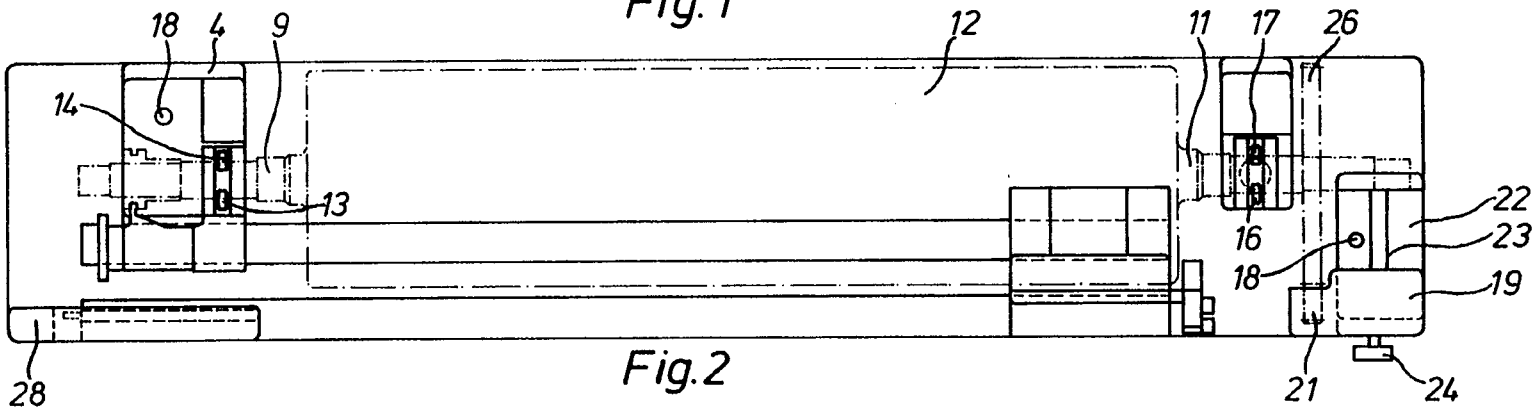
FIG. 2 is a top plan view of the apparatus of FIG. 1.
Figure 5:
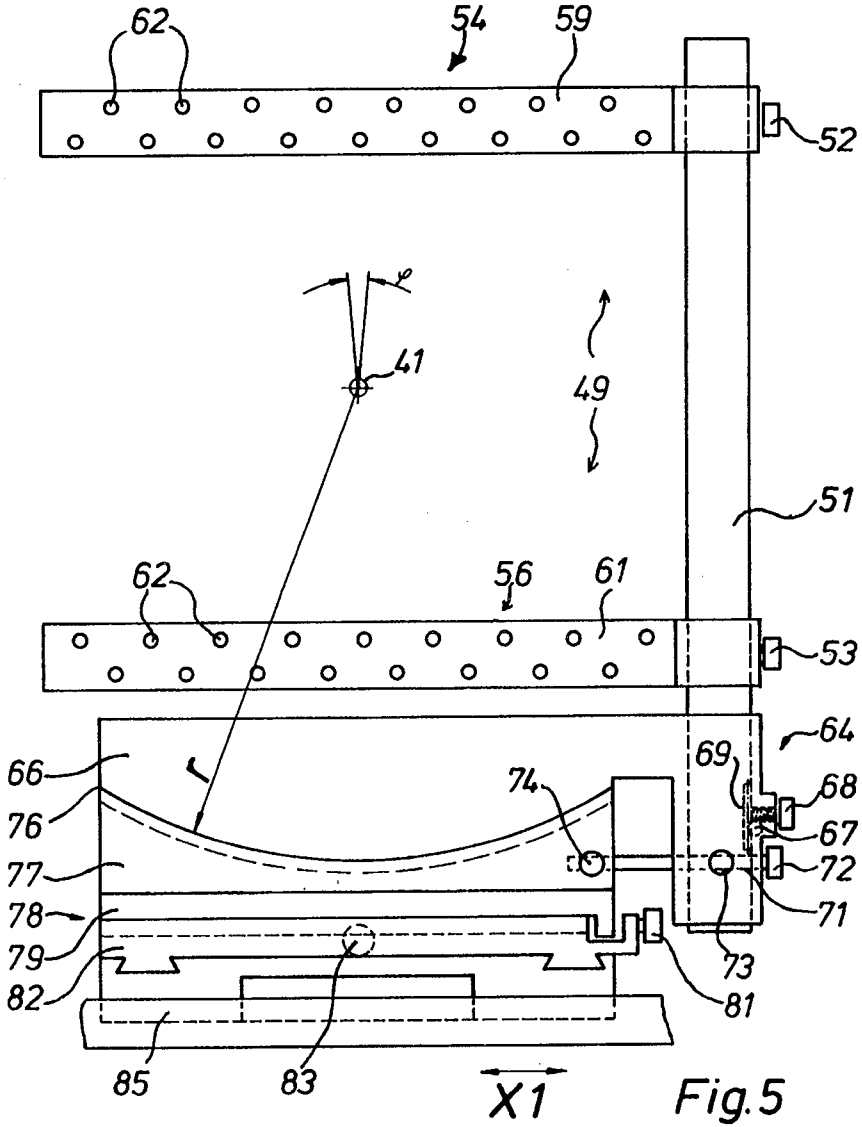
FIG. 5 is a front elevation view of a suction fork assembly.
Figure 6:
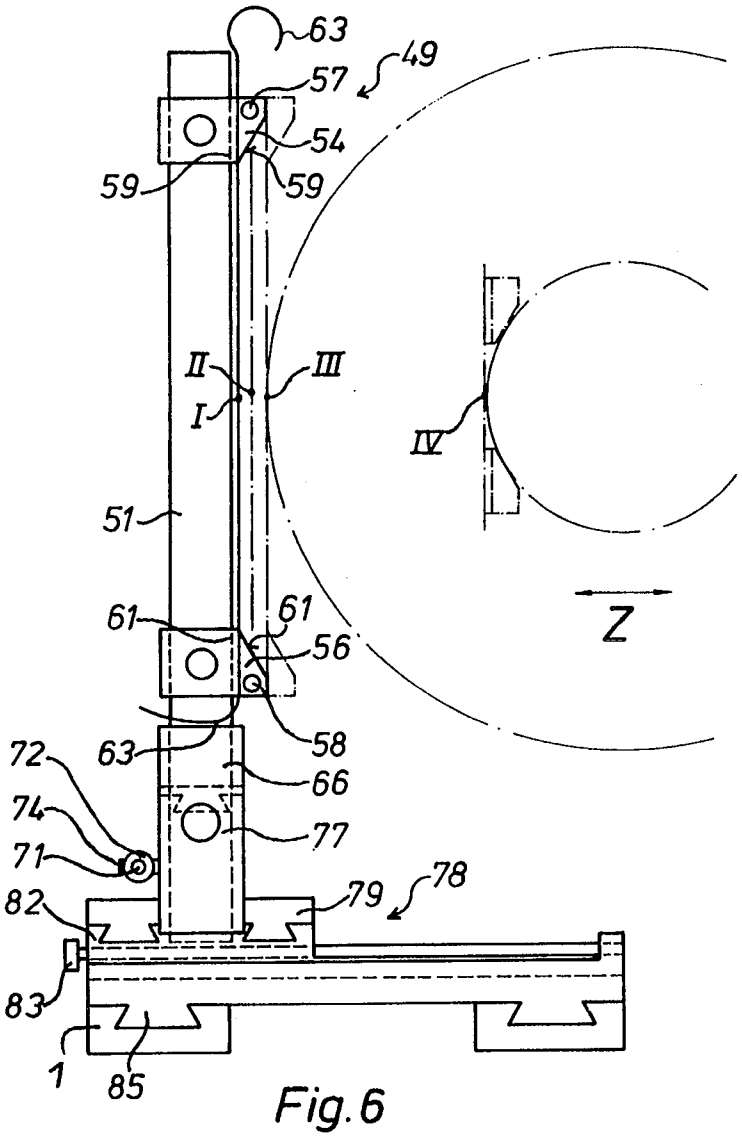
FIG. 6 is an end view of the suction fork of FIG. 5.
Figure 7:
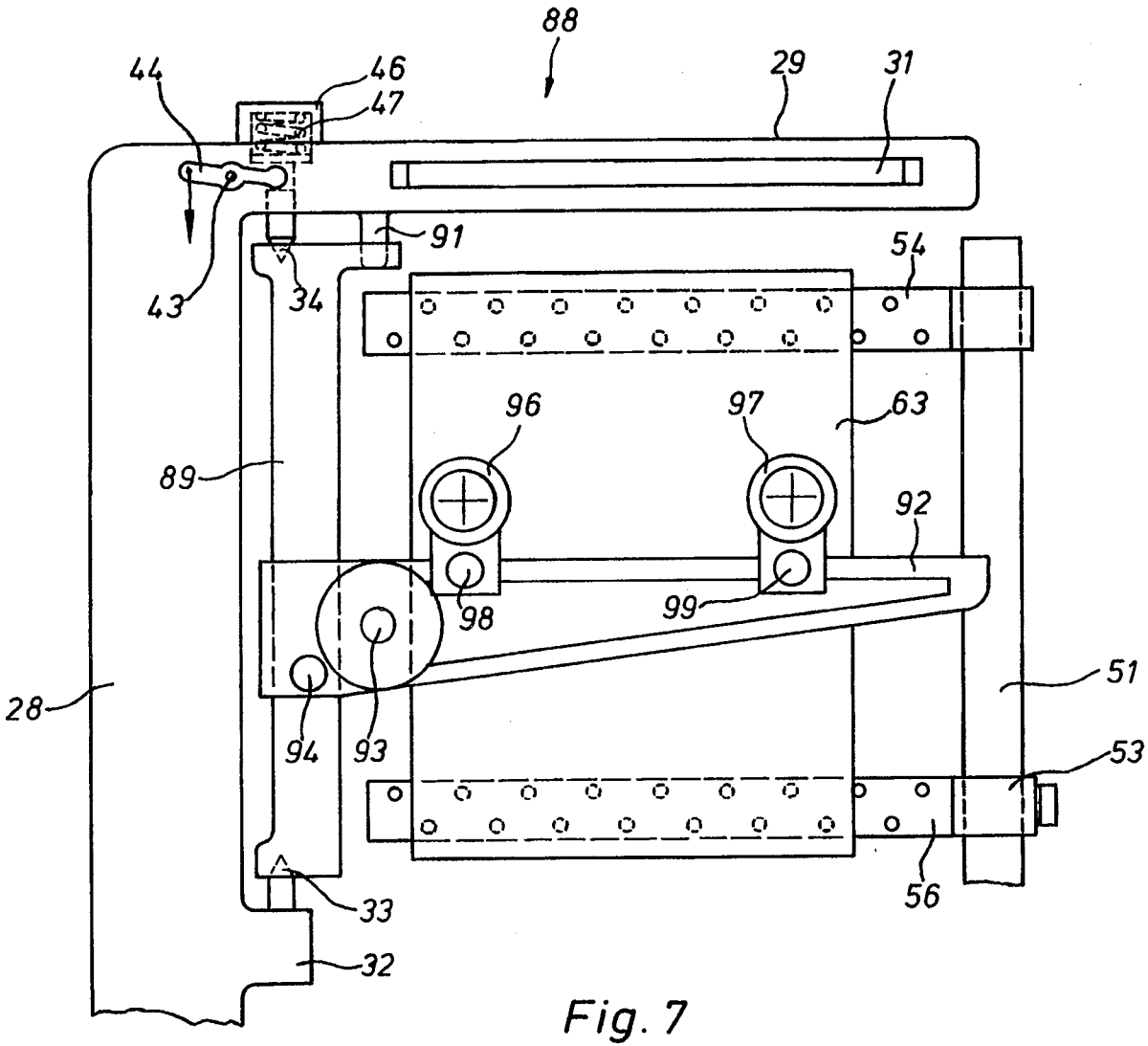
FIG. 7 is a front elevation view of a second preferred embodiment of a locating shield in accordance with the present invention and depicting the superimposing of the locating shield with the suction fork assembly.

Turning now to FIGS. 1, 5 and 6, there is shown generally at 49 a suction fork assembly whose purpose is to securely yet shiftably support a flexible printing plate 63 which will be brought into proper register in cooperation with the locating shield 36 so that the plate 63 can then be applied to the surface of the forme cylinder 12. The suction fork assembly, generally at 49, is shown in FIG. 1 in its initial position at the right end of the machine frame 1, generally adjacent the stationary bearing bracket 6. It will be understood that the suction fork assembly 49 is shiftable along the machine frame 1 in the direction indicated by X as a unit. The suction fork assembly 49 is also movable horizontally and vertically with respect to the machine frame 1 in the direction indicated at X1 and Y and can be moved toward and away from the periphery of the forme cylinder 12 in the direction indicated by the arrow Z in FIG. 6. The suction fork assembly 49 can also be rotated in a plane defined by spaced suction arms 54 and 56 through an angle $\phi$ as depicted in FIGS. 2 and 7. These various degrees of freedom of movement of the suction fork assembly 49 are effective to allow a flexible printing plate 63 supported by the suction fork assembly 49 to be properly positioned or registered through the use of the locating shield so that the registered printing plate 63 can then be accurately applied to the forme cylinder 12.

Referring now primarily to FIG. 5, the suction fork assembly, generally at 49 uses spaced upper and lower, horizontally extending suction arms 54 and 56, respectively, which are adjustably secured by clamp screws 52 to a vertically extending pillar 51. These upper and lower suction arms 54 and 56 are, as may be seen in FIG. 6, generally triangular in cross-section and each has a suction air connection 57 or 58, respectively. Each suction arm 54 and 56, has a plurality of suction holes 62 distributed over contact areas 59 and 61, respectively. These contact areas 59 and 61 can be provided with a corrugated surface or a powder coated surface so that they will provide a higher coefficient of friction with respect to the surface of a printing plate 63 which will be adhered to these contact areas 59 and 61 by the use of suction air through the suction holes 62. As may be seen in FIG. 6, the printing plate 63 may have a height that is greater than the spacing of the upper and lower suction arms 54 and 56. However, only a sufficient portion of the printing plate 63 required to effect accurate register of the plate need be supported between the spaced suction arms 54 and 56.

Referring again to FIGS. 5 and 6, the vertical pillar 51 of the suction fork assembly 49 is supported by an angular adjustment support 66 so that its upper end can be moved to the left or right, as seen in FIG. 5 to thereby effect a rotation of the plane defined by the suction arms 54 and 56 through the angle $\phi$ about the center point 41, as seen in FIG. 5. The pillar 51 is also shiftable vertically in the direction X since its lower end is received in a vertical adjusting assembly 64. The angular adjustment support 66 is in the form of an arc of a circle having a radius "r" whose origin is the center point between the suction arms 54 and 56 and which corresponds generally to the zero point 41 of the locating shield 36 of FIG. 4. The vertical adjusting assembly 64 for the pillar 51 of the suction fork 49 utilizes a worm wheel 67 which is driven by a hand wheel or a motor 68. The worm wheel 67 engages a toothed rod 69 that is attached to the pillar 51. It will be understood that if the worm wheel 67 is driven by a motor 68 that the motor 68 can be controlled by the control desk of the assembly of the present invention.

The pivotable or angular motion of the suction fork assembly 49 through the angle $\phi$ is accomplished by the use of a threaded spindle 71. A first end of the spindle 71 is driven by a suitable handle wheel or motor 72 and a second end of the spindle 71 is received in a threaded gimbal or ball joint bearing 74 that is secured to a receptacle portion 77 of the suction fork 49. An intermediate bearing 73 is used to support the threaded spindle intermediate the vertical adjusting assembly 64 and the receptacle part 77. Since the receptacle 77 is generally fixed, and the vertical adjustment assembly 64 is secured to the angular adjustment support 66, rotation of the threaded spindle will cause the angular adjustment support 66 and hence the pillar 51 to pivot through the angle $\phi$. This angle is generally in the range of 3° to either side of the vertical.

As may be seen in FIGS. 5 and 6, the angular adjustment support 66 is carried by the receptacle 77 by way of a dove-tail guide slot 67. This allows the angular adjustment support 66 to slide in the receptacle 77 without experiencing any unwanted motion. The receptacle 77 is part of a cross-table which is designated generally at 78 and which is utilized to accomplish the horizontal shifting of the suction fork 49 in the direction X1 with respect to the machine frame 1 with this direction X1 being shown in FIG. 2. This cross table 78 is also able to accomplish the shifting of the suction fork 49 in the front to rear direction Z with respect to the forme cylinder 12, as depicted in FIG. 6. To accomplish the longitudinal or axial adjustment movement X1, the cross table 78 is provided with a support 79 which can be actuated by an adjustment screw through the use of a hand wheel or motor 81. This adjustment screw is rotatably supported by a support bed 82 and is threaded into the support element 79. The support element 79 is slidable in a dove tail guide portion of the support bed 82. Thus rotation of the adjusting screw and motor or hand wheel 81 will shift the support element 79 in the direction X1 with respect to the support bed 82. The support bed 82 is, in turn, slidably supported by suitable dove tail guides on a positioning support 85. The support bed 82 is movable in the direction Z, as seen in FIG. 6 toward and away from the forme cylinder 12 by actuation of a suitable threaded lead screw 83 and an accompanying hand wheel or drive motor. Actuation of this lead screw 83 will thus shift the support bed 82 with respect to the positioning support 85. The positioning support 85 is supported, in turn, in dove tail guide slots in the machine frame 1, as seen in FIGS. 6 and also as seen in FIG. 1. Movement of the positioning support 85 along the machine frame 1 is done by a lead screw 84 with a hand wheel or motor 86 and accomplishes the shifting of the suction fork assembly 49 along the machine frame in the direction X whereas the movement of the support bed in the direction Z; movement of the support 79 in the direction X1; movement of the pillar 51 in the direction Y; and movement of the angular adjustable support 66 in the angular direction $\phi$ all effect a shifting of the suction arms 54 and 56 of the suction fork assembly 49 with respect to the machine frame 1. All of the various hand wheels and lead screws 68, 72, 81, 83 and 86 can be provided with suitable motor drives, each of which is connected with an impulse transmitter. All of these drive motors can be controlled from a central point, such as the control desk 87 of the assembly. This control desk 87 may include a computer having a screen, and keyboard as well as suitable control equipment for use in controlling the vacuum or suction installations and the like.

Turning now to FIG. 7, there may be seen a second preferred embodiment of a locating shield assembly 88 in accordance with the present invention. Whereas the first locating shield assembly, generally at 36 provided a support for a transparent proof of the printing plate 63 which was preferably supported on the locating shield assembly 36, in the second preferred embodiment shown in FIG. 7 the registering of the printing plate 63 is accomplished using two shiftable magnifying lenses 96 and 97 that are provided with register crosses. This second locating shield assembly, which is designated generally at 88 is provided with a fixing device in the form of a vertical support column 89 that is supported at its upper and lower ends by the bearing bolts 34 and 33, respectively. The support column 89 can rotate about a vertical axis defined by the aligned bearing bolts 33 and 34 and this rotation is limited by a suitable stop 91 that extends downwardly from the horizontal connecting bar 29. A cross support 92 is supported in a cantilever fashion on the support column 89. This cross support 92 can move vertically on support column 89, can pivot about a pivot connection 93, and is provided with a clamping screw 94. The pair of magnifying lenses 96 and 97 with their register crosses are slidably supported on the cross support 92 and each is provided with a clamping or lock screw 98 and 99, respectively.

This second locating shield 88 is particularly usable once a first printing plate 63 which is supported by the suction arms 54 and 56 of the suction fork assembly 49 has been registered vertically, laterally and for rotation. Once the zero position for this first plate 63 has been established, using preferably the first locating shield assembly 36, as will be discussed shortly, the first shield 36 can be removed from the vertical arm 28 and the second locating shield 88 can be substituted for it. The magnifying lenses 96 and 97 and their register crosses can be positioned in alignment with reference points, such as reference crosses on the first printing plate 63. These reference points that are now established by the reference crosses on the magnifying lenses 96 and 97 can now be used to place subsequent printing plates 63 that will be used to print the various other colors into proper register on the suction fork assembly 49 before they are transferred to the surface of the appropriate forme cylinder 12.

The method of operation of the apparatus for accomplishing the accurate registration and mounting of printing plates on forme cylinders in accordance with the present invention will now be discussed in detail. A printing plate 63 whose proper register is to be effected, is secured to the suction fork assembly 49 by placement against the contact areas 59 and 61 of the suction arms 54 and 56 and the application of a suction force to the suction holes 62. The printing plate 63 is applied to the suction arms 54 and 56 with its relief or printing face oriented away from the contact areas 59 and 61. The printing plate 63 is held by the suction arms 54 and 56 in a generally planar orientation. The suction fork assembly 49 is then moved across the machine frame 1 until it is positioned behind and in alignment with the locating shield 36 upon which has been positioned a transparent proof of a printing plate 63. This transparent proof of printing plate 63 has been attached to the transparent screen 38 of the locating shield 36 by means of adhesive tapes, vacuum holders, static electrical friction or the like. The transparent proof of the printing plate 63 may be properly registered on the transparent screen 38 of the locating shield 36 through the utilization of the register lines 39 on the screen 39 and the use of the reference crosses 40 and the zero point 41.

Once a transparent proof of a particular printing plate 63 has been secured to its locating shield 36 in proper register, it will remain on that locating shield 36. In other words, a particular locating shield 36 has one transparent proof secured to it. If another printing subject is to be properly registered, the locating shield 36 bearing the transparent proof of the first subject is removed by the actuation of the bearing bolt 34 and a different locating shield 36 is put up in its place. Each individual locating shield 36 can be identified by its unique identification marks 48, as was discussed previously.

The suction fork assembly 49 is moved into superimposed position with the locating shield 36 in a register position identified as position I in FIG. 6. In this position, the suction fork assembly 49 will be shifted or rotated in the X1, Y or $\phi$ directions to accomplish the exact register position of the printing plate 63 while using the transparent proof on the locating shield 36 as a guide. Once this exact register has been accomplished, as may be done using data from the CAD installation into the computer in the control desk 87 and thence to the various motors for the lead screws of the suction fork assembly 49, the suction fork assembly 49 can then be moved by the drive 86 to the transport level II or transport position II as shown in FIG. 6. In this transport position, the suction fork assembly 49 has moved from its congruent or superimposed position behind locating shield 36 to the position shown in FIG. 1.

Once the suction fork assembly 49 is in the transport position II, the drive means 83 is used to move the support bed 82 in the direction Z of FIG. 6 to the tangential gluing position indicated at either position III or position IV. Position III indicates the tangential gluing position of a printing plate 63 with respect to a forme cylinder 12 having a maximum diameter that can be accommodated by the print drive, while Position IV indicates the tangential gluing position of a printing plate 63 with respect to a forme cylinder 12 having a minimum diameter that can be accommodated by the present device.

Once the reverse side of the printing plate 63, which is provided with a suitable adhesive coating, has been brought into tangential contact with the periphery of the forme cylinder 12 in either Positions III or IV, as depicted in FIG. 6, the suction air to the suction arms 54 and 56 of the suction fork assembly 49 can be shut off by a suitable switch or control means. The printing press 63 can then be pressed, either by hand or by suitable mechanical means such as pneumatic press-on rolls or brushes, against the surface of the forme cylinder 12 in a properly registered position.

As was discussed above, once the initial printing plate 63 has been brought into proper register in Position I and before it is shifted to Position II, the first locating shield 36 can be removed and the second locating shield 88 can be put in plate on the vertical arm 28. The magnifying lenses 96 and 97 will be aligned with the now properly registered first printing plate 63 which can then be moved to positions II and III or IV. A second printing plate 63 that will be used to print a second color, can now be put up on the suction fork assembly 49 which can be moved to position I so that this second printing plate 63 can be brought into proper register using the lenses 96 and 97 and their register crosses. This second, registered printing plate 63 can now be shifted to Positions II and III or IV and can be applied to the forme cylinder 12. The same procedure can be followed until all of the appropriate printing plates 63 are attached in proper registration to the forme cylinder 12.

While a preferred embodiment of a method and apparatus for the accurate registering and mounting of printing plates on forme cylinders in accordance with the present invention has been set forth fully and completely hereinabove, it will be apparent to one of skill in the art that a number of changes in, for example, the overall size of the forme cylinder, the number of printing plates to be attached to the surface of the forme cylinder, the source of the suction air and the like could be made without departing from the true spirit and scope of the present invention which is accordingly to be limited only by the following claims.

What is claimed is:

1. An apparatus for registering and mounting a flexible printing plate on a forme cylinder of a printing press assembly, said registering and mounting apparatus comprising:

means for supporting a forme cylinder on a machine frame;

a printing plate support assembly slidably supported on said machine frame, said printing plate support assembly including spaced upper and lower suction arms;

means to releasably secure a printing plate to said printing plate support assembly;

means to support said support assembly on said machine frame for adjustable movement in at least three degrees of freedom;

a locating shield adapted to receive a transparent proof of a printing plate in accurate register;

means to position said printing plate support assembly in register alignment with said locating shield and to register a printing plate with said transparent proof; and means to position said printing plate support assembly adjacent a forme cylinder and to release a printing plate from said printing plate support assembly to a forme cylinder.

2. The registering and mounting apparatus of claim 1 wherein each of said suction arms includes a contact area provided with suction holes.

3. The registering and mounting apparatus of claim 2 wherein said contact area on each of said suction arms has a surface having means to provide a higher coefficient of friction.

4. The registering and mounting apparatus of claim 1 wherein said locating shield includes a frame and further wherein said frame supports a transparent screen which is provided with horizontal and vertical register lines and with set pins and a zero point.

5. The registering and mounting apparatus of claim 4 further including a support column on said machine frame and bearing bolts carried by said support column and wherein said frame for said transparent screen is removably secured to said support column on said machine frame by said bearing bolts.

6. The registering and mounting apparatus of claim 4 wherein said frame of said locating shield is provided with identification marks.

7. The registering and mounting assembly of claim 1 further including a vertical adjusting assembly on said machine frame and wherein said spaced suction arms are adjustably supported for vertical movement on said vertical adjusting assembly.

8. The registering and mounting assembly of claim 7 further including an angular adjustment support and wherein said vertical adjusting assembly is supported by said angular adjustment support.

9. The registering and mounting assembly of claim 8 further including a cross table which is movable in two directions and which is supported by said machine frame and wherein said angular adjustment support is mounted on said cross table.

10. The registering and mounting assembly of claim 9 further including a positioning support that is movable on said machine frame and wherein said cross table is carried by said positioning support.

11. The registering and mounting apparatus of claim 1 wherein said locating shield includes a cross support which carries spaced, adjustable first and second magnifying lenses having register crosses.

12. A method for registering and mounting a flexible printing plate on a forme cylinder of a rotary printing press assembly, said method including the steps of:

supporting a forme cylinder on a machine frame;

providing a printing plate support assembly having spaced lower and upper suction arms for releasably supporting a printing plate to be placed in register;

positioning a flexible printing plate on said spaced suction arms and supplying a suction force to said spaced suction arms to releasably secure a reverse surface of said printing plate to said spaced suction arms in a planar orientation;

supporting said printing plate support assembly on said machine frame having movement in at least three degrees of freedom;

providing a locating shield assembly having a transparent screen on said machine frame;

attaching a transparent proof of a printing plate in proper register to said transparent screen;

locating said printing plate support assembly in register alignment with said locating shield;

moving said printing plate support assembly in selected ones of said degrees of freedom and registering said printing with said transparent proof;

shifting said printing plate support assembly and bringing said registered printing plate into contact with said forme cylinder; and releasing said printing plate from said printing plate assembly to said forme cylinder.

* * * * *